United States Patent [19]

Cribbs

[11] 4,027,615

[45] June 7, 1977

[54] BOAT ANCHOR

[76] Inventor: Roland F. Cribbs, 86 Bahama Circle, Tampa, Fla. 33606

[22] Filed: Oct. 23, 1975

[21] Appl. No.: 625,004

Related U.S. Application Data

[63] Continuation of Ser. No. 513,239, Oct. 9, 1974, abandoned.

[52] U.S. Cl. ..... 114/311

[51] Int. Cl.[2] ..... B63B 21/24

[58] Field of Search ..... 114/206 R, 209, 168, 114/230; 294/74, 66 R

[56] References Cited

UNITED STATES PATENTS

| | | | |
|---|---|---|---|
| 1,621,809 | 3/1927 | Petersen | 114/230 |
| 3,841,685 | 10/1974 | Kolodziej | 114/230 X |

*Primary Examiner*—Trygve M. Blix
*Assistant Examiner*—Sherman D. Basinger
*Attorney, Agent, or Firm*—Arthur W. Fisher, III

[57] ABSTRACT

A boat anchor configured to facilitate dislodgement from hooking engagement with the various foreign objects at the bottom such as rocks, ledges and the like. The boat anchor comprises a weighted body member in combination with at least one substantially flexible anchoring element. The weighted body member comprises an elongated substantially rigid element having the substantially flexible anchoring element attached to opposite ends thereof.

4 Claims, 2 Drawing Figures

BOAT ANCHOR

This application is a continuation of patent application Ser. No. 513,239 filed Oct. 9, 1974 and now abandoned.

BACKGROUND OF THE INVENTION

1. Field of the Invention

A boat anchor comprising a weighted rigid body member in combination with at least one substantially flexible anchoring element.

2. Description of the Prior Art

Numerous boat anchors have been designed to minimize fouling problems of weeds, dragging of the anchor and inability to release the anchor from foreign objects such as rocks and ledges. Generally, such anchors used with small watercraft comprise a central shaft having a dish-shaped bottom portion. Unfortunately, such anchors are only partially successful since they often drag along the bottom of the body of water on which the watercraft is located. In addition such anchors can become lodged between rocks or the like, making it difficult to retrieve from the bottom of the body of water.

Grapnel anchors have also been widely used for anchoring such smaller watercraft. Anchor dragging is not so prevalent since the flukes thereof generally engage or hook onto foreign objects at the bottom more readily than the dish-shaped bottom of the anchor. However, the grappling or hooking action of the latter type of anchor often presents problems since the anchor is not easily dislodged from hooking engagement with various foreign objects at the bottom. Moreover, it will be appreciated that the flukes of such anchors are normally exposed and may cause damage to the watercraft hull dropped against the hull. In addition such anchors generally require substantial space during storage and transportation.

To overcome the problems of fouling, a number of complicated spring action or weighted members anchors have been developed. Generally such anchors are expensive to manufacture and given to operational malfunctions.

Thus there is a need for an inexpensive boat anchor configured to minimize the possibility of anchor fouling.

SUMMARY OF THE INVENTION

The present invention relates to a boat anchor. More specifically the boat anchor comprises a body member in combination with an anchoring means configured to facilitate dislodgement from hooking engagement with objects on the bottom of the body of water.

The body member comprises an elongated weighted element having an attachment means formed thereon. The attachment means is disposed on the mid-portion of the elongated weighted element to receive a mooring or anchoring line extending between the anchored boat and boat anchor. The elongated weighted element is curved in configuration to accommodate the anchoring means in operative position as more fully described hereinafter.

The anchoring means comprises at least one flexible anchoring element attached to opposite ends of the body member. A plurality of flexible anchoring elements may be employed to increase the holding strength of the boat anchor and enhance the engaging action thereof.

As can be recognized the dimensions and weight of both the body member and anchoring means can be designed to permit use of the boat anchors with boats of various sizes and with various foreign objects.

In use, the boat anchor is interconnected to the boat by a mooring or anchoring line secured to the attachment means. The boat anchor is dragged along the bottom of the body of water until the anchoring means engages rocks, coral or the like securing the boat anchor thereto. Once the boat is thus secured, it will remain so secured until disengaged by the boat operator. The flexible nature of the anchoring means permits the boat anchor to be easily detached from the rocks, ledges, coral or the like by maneuvering the boat relative thereto dislodging the boat anchor from the bottom.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
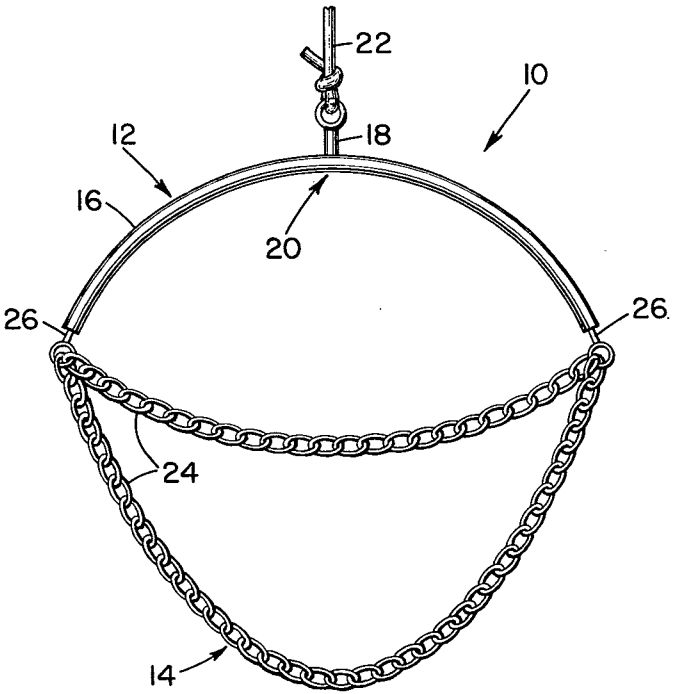
FIG. 1 is a side view of a boat anchor.
Figure 2:
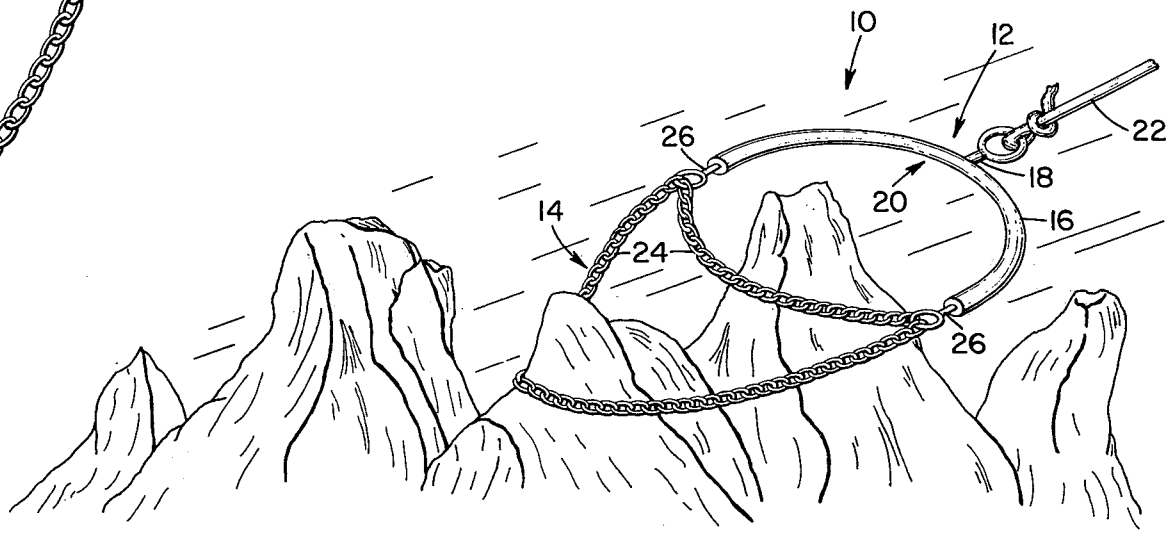
FIG. 2 is a perspective view of the boat anchor in use.

As shown in FIGS. 1 and 2 , the present invention relates to a boat anchor generally indicated as 10. The boat anchor 10 comprises a body member 12 and anchoring means 14 as described more fully hereinafter. As has been previously discussed, the anchor may easily become lodged under rocks, weeds or other foreign objects within the body of water making it extremely difficult or impossible to dislodge. The particular configuration and design of the instant boat anchor 10 to facilitate dislodgement from hooking engagement with the foreign objects.

The body member 12 comprises an elongated, rigid element 16. An attachment means 18 if formed on the mid-portion 20 of the elongated, rigid element 16 to receive a mooring or anchoring line 22 which operatively interconnects the boat (not shown) and the boat anchor 10. The elongated, rigid element 16 is curved in configuration to accommodate the anchoring means 14 in operative position as more fully described hereinafter. Of course, the elongated, rigid element 16 may be V or U shaped in configuration with equal efficiency. The elongated, rigid element 16, which may be constructed of galvanized or other rust resistant material, is weighted to permit use with larger pleasure boats.

The anchoring means 14 comprises at least one flexible anchoring element 24 attached to opposite ends 26 of the body member 12. A plurality of flexible anchoring elements 24 may be used to increase the holding strength of the boat anchor 10 and enhance the engaging action thereof. The dimensions and weight of both the body member 12 and anchoring means 14 can be designed to permit use of the boat anchor with boats (not shown) of various sizes and with various foreign objects.

In use, the boat anchor 10 is interconnected to the boat (not shown) by a mooring or anchoring line 22 secured to the attachment means 20. The boat anchor 10 is dragged along the bottom of the body of water until the anchoring means 14 engages rocks, ledges, coral or the like securing the boat anchor 10 thereto. Once the boat (not shown) is thus secured, it will remain so secured until disengaged by the boat operator. The flexible nature of the anchoring means 14 permits the boat anchor 10 to be easily detached from the rocks, ledges, coral or the like by maneuvering the boat (not shown) relative thereto dislodging the boat anchor 10 from the bottom.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

What is claimed is:

1. A drag type boat anchor for use with a boat specifically configured to facilitate anchoring engagement and disengagement with objects lodged on the bottom of a body of water; said boat anchor comprising a substantially rigid unitary elongated body member having an attachment means formed thereon, said attachment means for attaching a line to said substantially rigid unitary body member, said line extending between said boat anchor and the boat, said attachment means being formed at substantially the mid-portion of said substantially rigid unitary elongated body member to maintain said substantially rigid unitary body member on the substantially horizontal position, anchoring means including at least one substantially flexible anchoring element to engage objects lodged on the bottom of the body of water, said substantially flexible anchoring element being fixedly attached to opposite ends of said substantially rigid unitary elongated body member such that said boat anchor engages and disengages objects lodged on the bottom of a body of water by the horizontal position of said boat anchor relative to the objects.

2. The boat anchor of claim 1 wherein said body member comprises a substantially rigid elongated weighted element.

3. The boat anchor of claim 2 wherein said elongated weighted element comprises a substantially curved configuration.

4. The boat anchor of claim 1 wherein said anchoring means includes a plurality of substantially flexible anchoring elements.

* * * * *